US006382430B1

(12) United States Patent
Dewsnap

(10) Patent No.: US 6,382,430 B1
(45) Date of Patent: May 7, 2002

(54) PRODUCT DELIVERY DEVICE

(76) Inventor: Paul D. Dewsnap, Ledan, Inc., 52 E. 2nd St., Mineola, NY (US) 11501

( * ) Notice: Subject to any disclaimer, the term of this patent is extended or adjusted under 35 U.S.C. 154(b) by 0 days.

(21) Appl. No.: 09/447,421

(22) Filed: Nov. 23, 1999

Related U.S. Application Data

(60) Provisional application No. 60/131,519, filed on Apr. 29, 1999.

(51) Int. Cl.[7] ..... A47F 7/00

(52) U.S. Cl. ..... 211/59.2; 211/162; 211/94.01

(58) Field of Search ..... 211/59.1, 57.1, 211/94.01, 162, 59.2; 206/470, 461, 464, 465, 466, 232

(56) References Cited

U.S. PATENT DOCUMENTS 2,460,997 A * 2/1949 Myers ..... 211/162 X
3,027,015 A * 3/1962 Miller ..... 211/94.01
3,175,243 A * 3/1965 Weber ..... 211/162
3,853,222 A * 12/1974 Helms ..... 206/315
4,804,270 A * 2/1989 Miller et al. ..... 356/355
5,038,978 A * 8/1991 Kolton et al. ..... 223/85
5,067,620 A * 11/1991 Norrie ..... 211/113
5,547,156 A * 8/1996 Djuric ..... 248/307
5,711,432 A * 1/1998 Stein et al. ..... 211/57.1
5,806,704 A * 9/1998 Jamison ..... 220/212
5,862,925 A * 1/1999 Grzywinski ..... 211/162
5,865,326 A * 2/1999 Spamer et al. ..... 211/181.1
5,947,303 A * 9/1999 Rololin ..... 211/59.2
5,983,432 A * 11/1999 Jones ..... 15/21.2
6,004,597 A * 12/1999 Coleman et al. ..... 426/112

* cited by examiner

*Primary Examiner*—Daniel P. Stodola
*Assistant Examiner*—Khoa Tran
(74) *Attorney, Agent, or Firm*—Charles E. Temko

(57) ABSTRACT

A delivery track construction for use with display coolers, and dispensing devices for relatively perishable packaged products. The construction includes at least one pair of parallel inclined tracks having first and second terminal ends for gravity feeding of packages from the first to the second end. The packages are supported by a track-engaging member which slidably engages the rails. In one embodiment, the track-engaging member is in the form of a T-shaped hook defining a pair of recesses which engage the rails. In another form, the track-engaging member is in the form of a sphere of diameter sufficient to span the interstice formed by the rails. In another embodiment, the track is formed by a inclined lower wall and a pair of parallel vertical walls adapted to support cylindrical containers in parallel vertical orientation for serial dispensing.

1 Claim, 6 Drawing Sheets

10
12
11
22
24
220
272
80
70
71
72
73
74
75
152
155
156
159
160

PRODUCT DELIVERY DEVICE

RELATED APPLICATION

Reference is made to my copending Provisional Patent Application Ser. No. 60/131,519, filed Apr. 29, 1999, which discloses part of the subject matter disclosed and claimed in this application.

BACKGROUND OF THE INVENTION

This invention relates generally to the field of product delivery devices typically including refrigerated coolers for serially dispensing packaged products which are relatively perishable, and are often packaged in dated containers indicating the period beyond which the product is no longer considered fresh. More particularly, it relates to an improved track construction for serially moving containers to a point of disengagement by a user.

The present state of the art is highly developed, and diverse attempts have been made to cope with the long standing problems involved with such structures. Among the most pertinent are those related to maximum utilization of available space within the cooled area, trouble-free operation, and the need for dispensing older stock in preference to newer stock. It is also desirable that inlet and outlet locations be substantially adjacent to permit front loading where the cooler is installed against a vertical wall, as is commonly the case.

In my prior U.S. Pat. No. 5,578,862, granted Mar. 14, 1999, there is disclosed a device for dispensing bottled beverages utilizing a channel construction of U-shaped configuration in which the first and second rectilinear sections of the channel are in non-planar relation, so that one free end of the channel is positioned substantially above the other free end to permit loading of the channel with product at the upper end, so that each loaded bottle is conducted under gravity away from the upper end until the channel is completely filled to provide an indication to service personnel of such condition. Where multiple channels are arranged in stacked relation, maximum space utilization is accomplished.

However, there are many other products having shelf life substantially shorter than carbonated beverages which heretofore have been positioned in a cooling device for relatively random selection by a food market customer, who if at all concerned, is interested only in assuring that the period of acceptable freshness has not passed. Service personnel who replace selected items are not always careful when replenishing packages to place the older packages nearer to the area of easy access. It has been estimated that as much as ten to fifteen percent of some products become unsaleable as a result of lack of care in restocking.

In the above-mentioned U.S. Pat. No. 5,578,862, there is disclosed a device for dispensing bottled beverages, with the bottle engaged at the neck or finish portion thereof. In recent years, there has been increased use of packaging beverages, both carbonated and non-carbonated, in metallic cans which do not have a neck or finish or other available means of engaging a conveying track which, nevertheless, can benefit from dispensing structure offering a first-in, first-out, type of operation.

SUMMARY OF THE INVENTION

Briefly stated, the invention contemplates the provision of novel structured components which may be incorporated into or made part of a package containing a dated product which may be used in conjunction with devices of the type described in my above mentioned patent to enable single or multiple delivery construction which, when properly employed, will assure that older stock will be delivered first, and which will discourage a customer from attempting to obtain the most recently dated stock. To this end, in a first embodiment, I have provided a novel track-engaging element which is either secured to or forms an integral part of the package, and includes means for slidably engaging a channel for gravity feed to a delivery terminal at the end of the channel. This construction is such that it may be incorporated into a package of flat, circular, cylindrical, frustoconical configuration, as well as bubble type packaging.

In another embodiment, I have provided a dispensing structure capable of handling cylindrical cans for serial dispensing in axially vertically disposed orientation, as contrasted with axially horizontal configuration known in the prior art, for superior space utilization and more reliable functioning.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENTS

Figure 1:
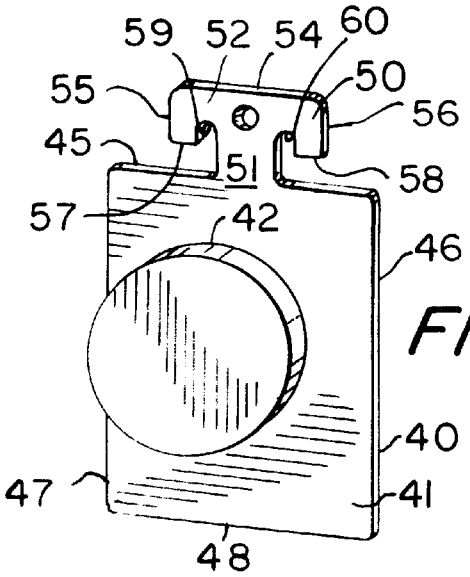
FIG. 1 is a perspective view of a first embodiment of the invention.

In accordance with the first embodiment of the invention, the device, generally indicated by reference character 10 (FIG. 3), includes a plurality of track elements 11 supported within a refrigerated display element 12, the track elements serving to contain and dispense in serial fashion, a plurality of product container packages. While, for purposes of illustration, the product is contained in a bubble type package as shown in FIG. 1, it will be understood that the package may also be of flat rectangular configuration (not shown) as might be the case when packaging sliced cheese and the like.

The track elements 11 are somewhat modified from those disclosed in my above-mentioned patent, and include a wire frame 20 defining upper and lower rectilinear portions 21 and 22 interconnected by a U-shaped portion (not shown). Peripheral frame members 24 support laterally-extending upper members 26 from which depend first and second rails 30 and 31 supported by curved brackets 32, the rails 30–31 being maintained in position to define a constant width continuous interstice 33.

Referring to FIG. 1, there is illustrated a typical bubble package 40, including a planar fibrous member 41 to which a synthetic resinous bubble member 42 is laminated to enclose a food product, typically, sliced bologna, ham, or the like.

The package 40 is bounded by an upper edge 45, side edges 46 and 47, and a lower edge 48. Extending from the upper edge 45 is an integrally-formed T-shaped hook member 50 including a vertical portion 51 and a horizontal portion 52. The portion 52 is bounded by an upper edge 54, side edges 55 and 56, as well as lower edges 57 and 58 forming semi-circular recesses 59 and 60 which are adapted to slidably engage the rails 30 and 31.

Figure 3:
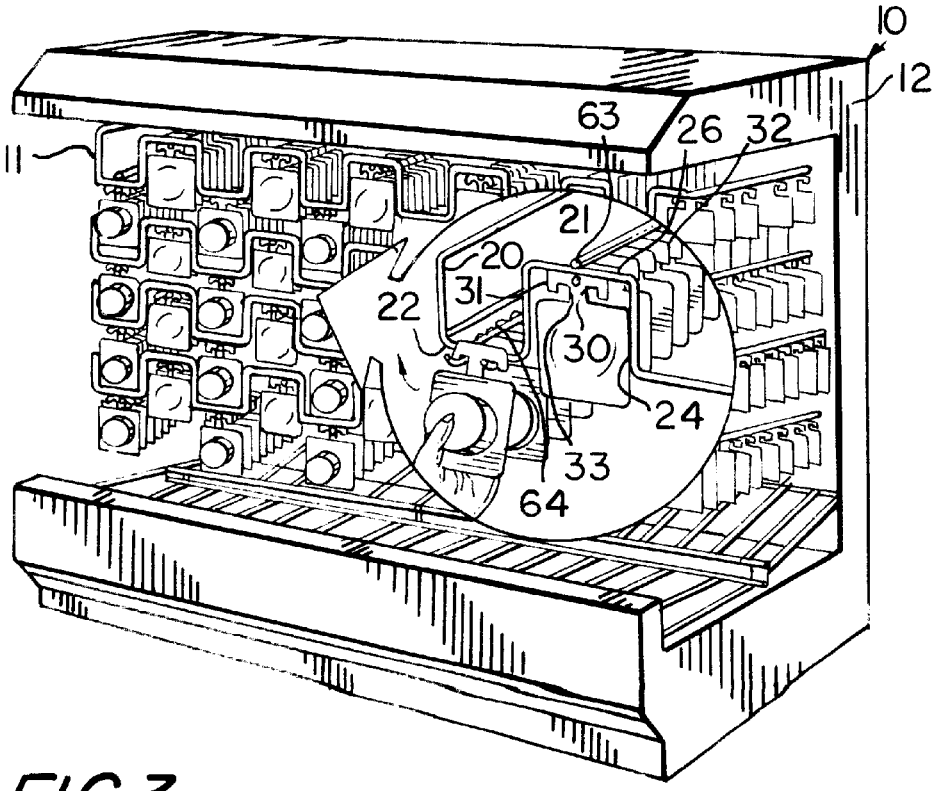
FIG. 3 is a perspective view showing the first embodiment in use in conjunction with a refrigerated display device.

Operation of the device will be apparent from a consideration of FIG. 3, wherein packages are engaged at an upper loading terminal 63 so as to move, under the action of gravity, to a discharge terminal 64 for serial removal by a customer.

Figures 2, 4:
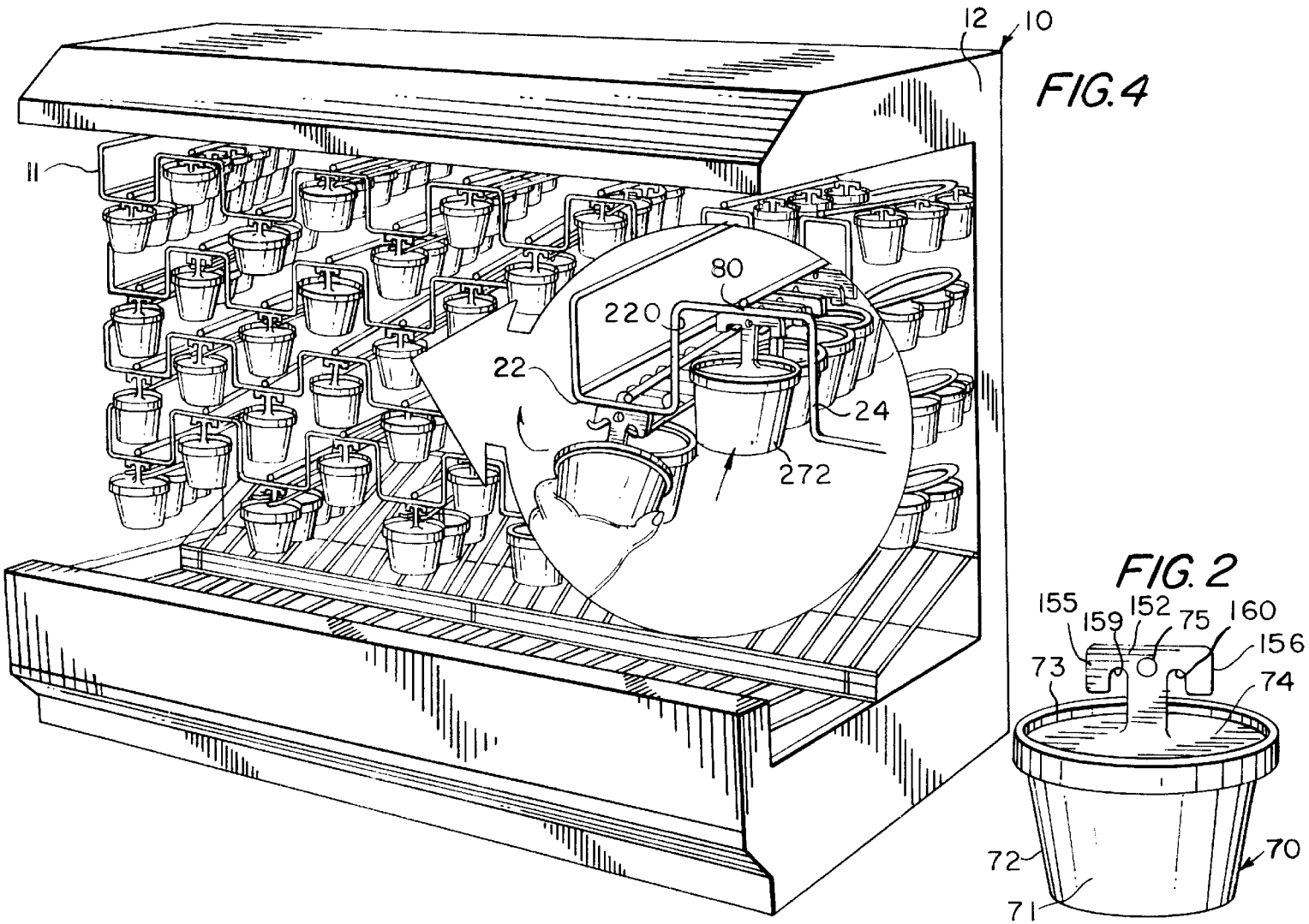
FIG. 2 is a perspective view of a second embodiment of the invention.
FIG. 4 is a similar perspective view showing the second embodiment in use in conjunction with a refrigerated display device.

Turning now to the second embodiment, generally indicated by reference character 70 (FIG. 2), to avoid needless repetition, parts corresponding to those of the first embodiment have been designated by similar reference characters with the additional prefix "1".

The second embodiment utilizes a frusto-conical synthetic resinous molded tub 71, including a lower cup-shaped member 72 and a corresponding resiliently engaged cover 73. Extending from the upper surface 74 thereof is an integrally molded hook 75 similar to that employed in the first embodiment.

It will be understood by those skilled in the art that the hook 75 may also be molded to laterally project from an outer surface of the lower member 72, for convenience in molding, and avoid the placing of any stress on the cover 73 when the article is hung on the rails 30–31.

Figure 5:
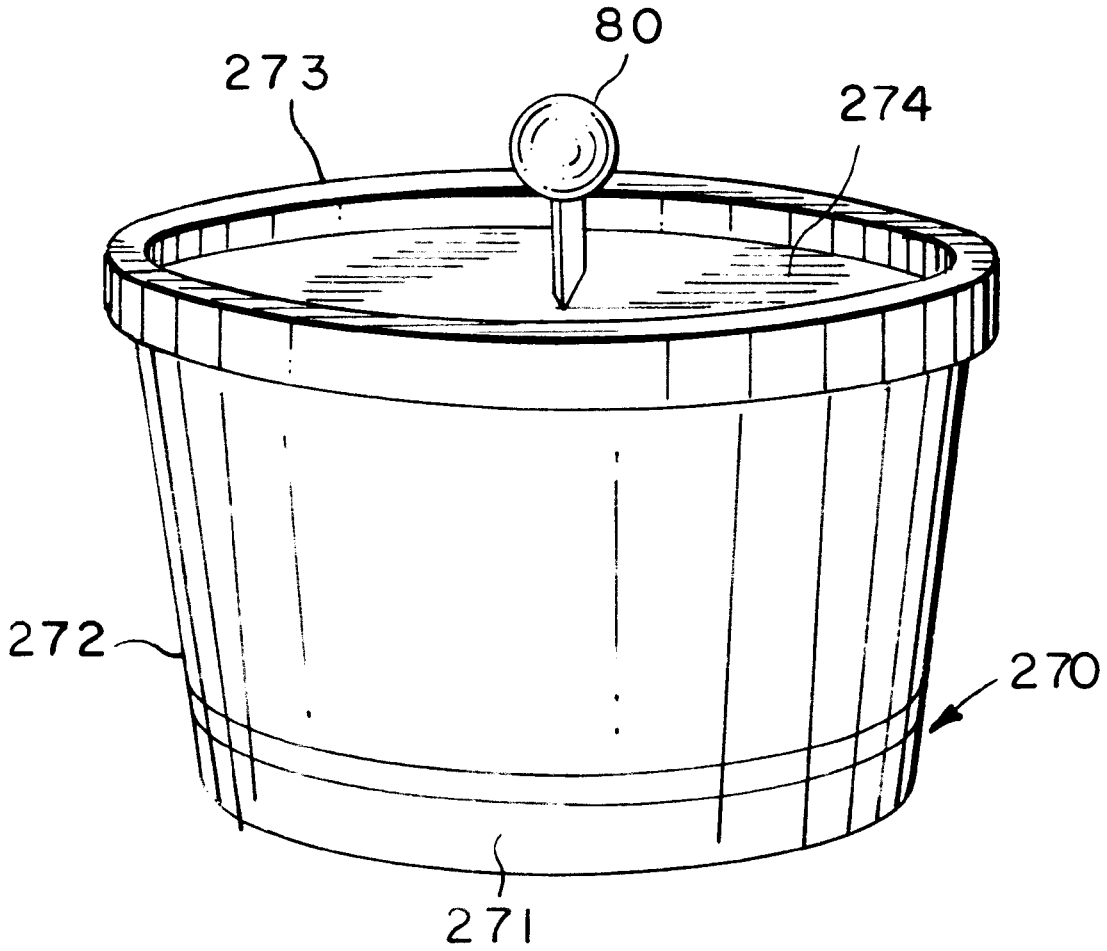
FIG. 5 is a perspective view showing an alternate form of the second embodiment.
Figure 6:
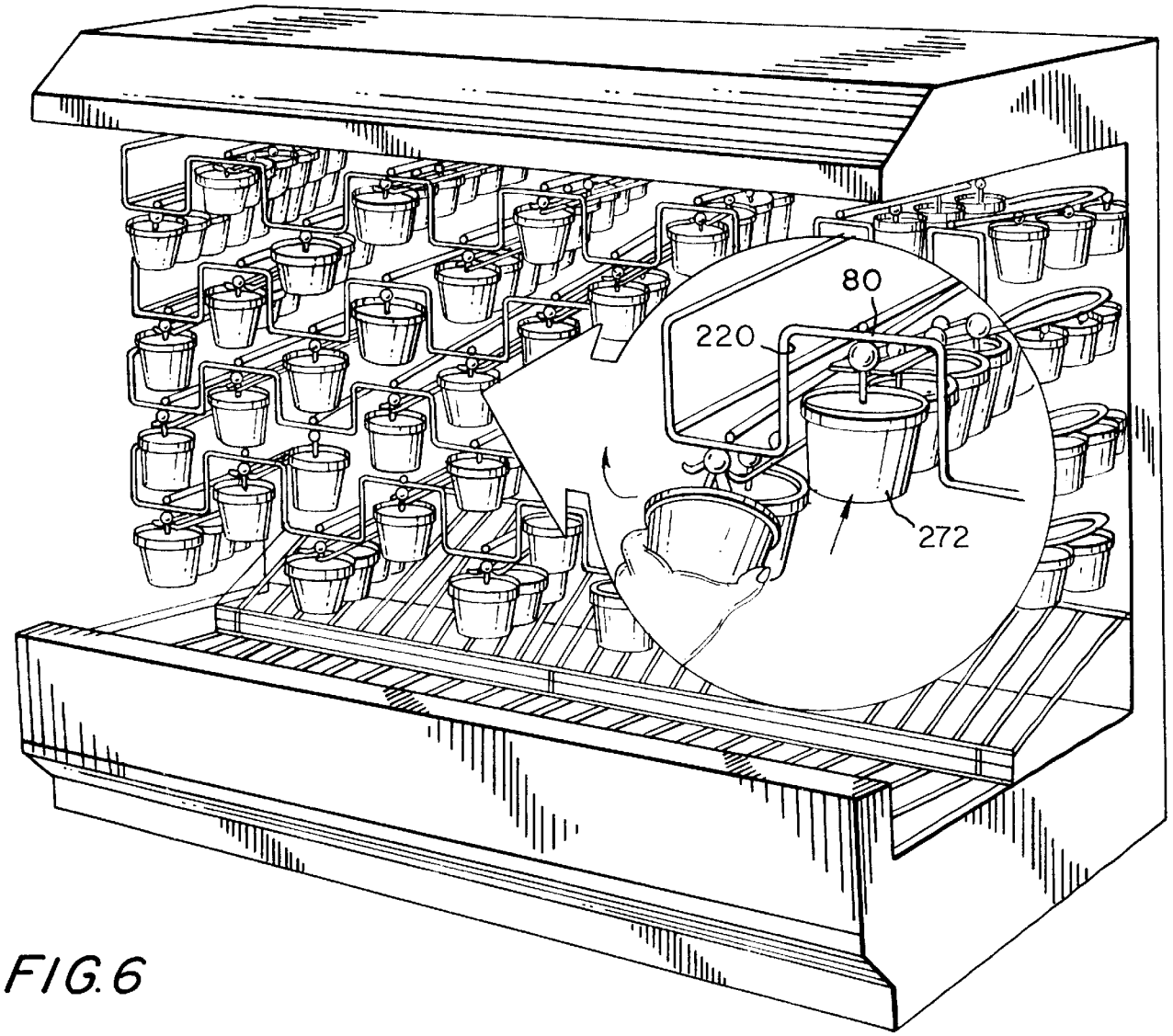
FIG. 6 is a perspective view corresponding to that seen in FIG. 4, showing the form illustrated in FIG. 6 in use.

Turning now to the alternate form of the second embodiment illustrated in FIGS. 5 and 6, parts corresponding to those of the second embodiment have been designated by similar reference characters with the additional prefix "2", thereby avoiding needless repetition.

In this form, the T-shaped hook member 75 is replaced by a spherical ball 80 of diameter substantially equal to the width of the hook 75, so that it may engage the rails 230–231 in sliding fashion. This version is particularly suitable where the package is of other than circular cross section, and requires a degree of orientation when engaged with the track members.

The spherical ball 80 is interconnected to the product container 271 by an integrally molded planar member 81 having side surfaces, one of which is indicated by reference character 82 and vertically-oriented side edges 83 and 84. The horizontal width of the member 81 may be as shown in FIG. 5, wherein it is less than the width of the interstice between the rails 230 and 231 allowing for a degree of rotation of the product package where it is of non-cylindrical cross section, to permit greater space utilization of the track length.

In other cases, it is desirable to limit the ability of the package to rotate, as for example, the package illustrated in FIG. 1. This is accomplished by spacing the rails 230 and 231 to define a relatively narrow interstice therebetween of less width than the width of the member 81, and preferably of a width only slightly greater than the thickness of the member 81, so that the side surfaces 82 have a substantially constant sliding contact with the rails to provide the equivalent of the guiding function provided by the hook member 50.

Figure 7:
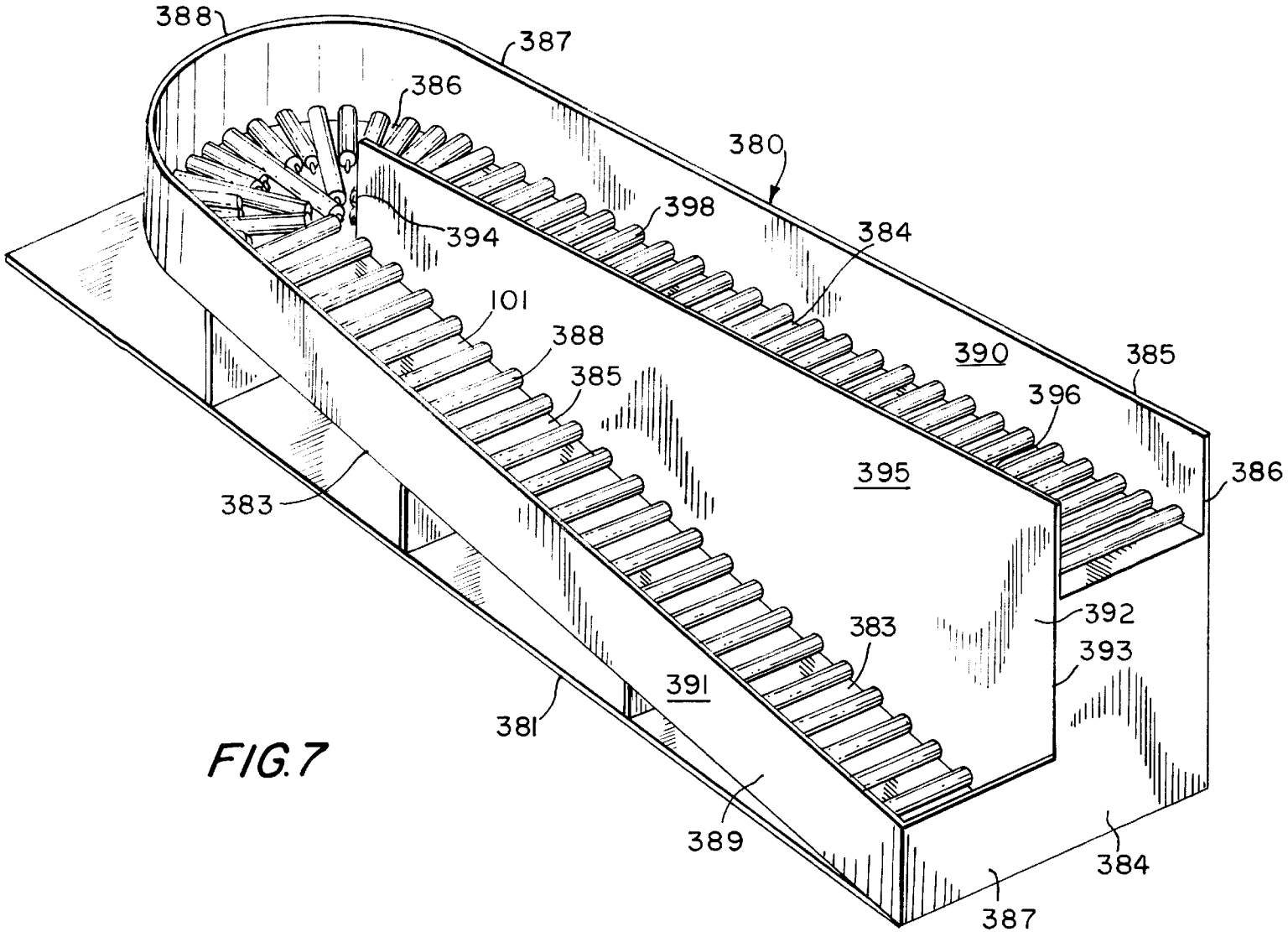
FIG. 7 is a perspective view showing a third embodiment of the invention.

Referring to FIG. 7, the third embodiment, generally indicated by reference character 380, includes a supporting platform 381, and a u-shaped channel element 382. The channel element includes an inclined lower base wall 383, an end wall 384, and a unitary outer wall 385 extending from a first end 386 and having a first rectilinear portion 387, a curvilinear portion 388, a second rectilinear portion 389, and continuous inner and outer surfaces 390 and 391. A centrally-positioned planar wall 392 includes first and second ends 393 and 394 and first and second planar surfaces 395 and 396.

The upper surface 101 of the base wall 383 includes first and second rectilinear portions interconnected by a curved portion. If these portions are sufficiently smooth, it is possible to transport the containers, generally indicated by reference character 397, from the upper to lower ends under the action of gravity. However, movement is facilitated by the provision of a plurality of laterally-extending rollers 398 of relatively small diameter, or captive balls (not shown i.e., approximately one-quarter the diameter of the diameter of the containers.

Figure 8:
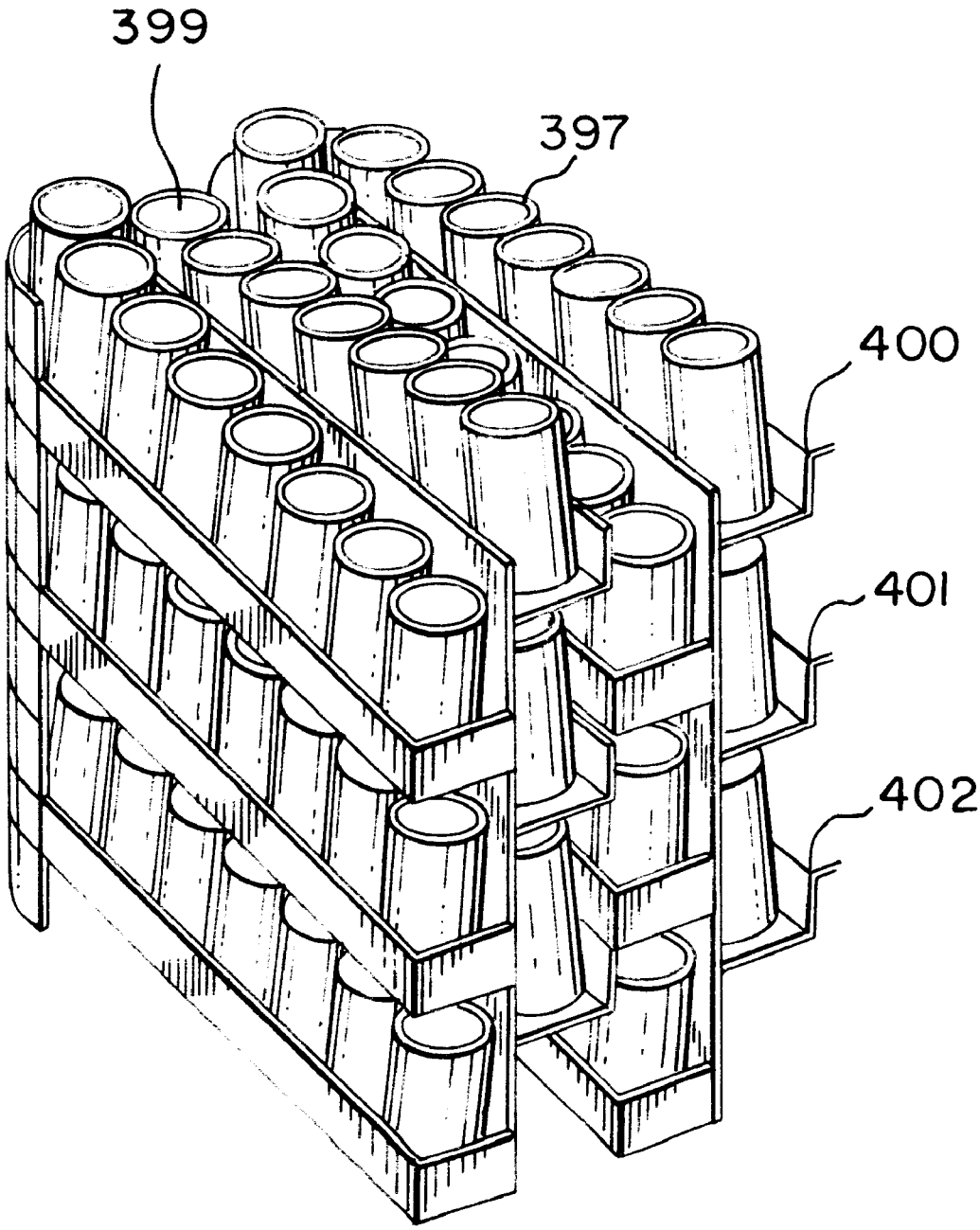
FIG. 8 is a perspective view showing an alternate form of the third embodiment.

In the alternate form 399, illustrated in FIG. 8, first, second, and third dispensing devices 400, 401, and 402 are disposed in stacked relation for maximum space utilization, and permitting the dispensing of, for example, differently flavored beverages.

It may thus be seen that. I have invented novel and highly useful improvements in the field of product delivery which employ structure of the type described in my prior U.S. Pat. No. 5,878,862 wherein the disclosed concept is applied to provide for the delivery of packages of other than necked bottle type, including in two embodiments packages commonly used for enclosing perishable food items. This is accomplished by providing a hook-like or similar track engaging member adapted to slidably engage a pair of inclined tracks so that the package may slide under the action of gravity from a loading point to a discharge point for serial availability to a user. The hook may be installed on a wide variety of package configurations, and may be integrally molded as a part of the package, or provision can be made for subsequent attachment to a surface or edge of a package where needed.

I have also disclosed embodiments capable of handling containers of cylindrical configuration having no means for engagement other than contact with the outer surfaces thereof, in which I have provided means for maintaining the containers in upright condition without causing jams in the path of movement, and permitting convenient loading and dispensing on a first-in, first-out basis.

I wish it to be understood that I do not consider the invention to be limited to the precise details of structure shown and set forth in the specification, for obvious modifications will occur to those skilled in the art to which the invention pertains.

I claim:

1. The product delivery device including a gravity feed track conveying a container from a first loading end to a second dispensing end, said track including first and second rails supported in parallel relations to define a substantially constant width interstice therebetween, the improvement comprising: a track engaging member forming part of said container and extending therefrom, said track engaging member slidably engaging each of said first and second rails, said track engaging member being in the form of a sphere of diameter greater than the interstice formed by said first and second rails, said sphere being interconnected to a generally planar vertically oriented member at an upper end thereof, said planar member having a lower end interconnected to said container; said planar member being of given thickness, wherein the interstice between said first and second rails closely corresponds to said given thickness to substantially prevent rotation of said container after engagement with said track.

* * * * *